US006908058B2

(12) United States Patent
Moon et al.

(10) Patent No.: US 6,908,058 B2
(45) Date of Patent: Jun. 21, 2005

(54) HOSE REEL CART WITH ELEVATED CRANK HANDLE

(75) Inventors: Brian Moon, Dekalb, IL (US); Jed Richardson, Batavia, IL (US)

(73) Assignee: Suncast Corporation, Batavia, IL (US)

( * ) Notice: Subject to any disclaimer, the term of this patent is extended or adjusted under 35 U.S.C. 154(b) by 0 days.

(21) Appl. No.: 10/402,264

(22) Filed: Mar. 28, 2003

(65) Prior Publication Data

US 2004/0188558 A1 Sep. 30, 2004

(51) Int. Cl.[7] ..... B65H 75/40

(52) U.S. Cl. ..... 242/403.1; 242/395.1; 137/355.26

(58) Field of Search ..... 242/395, 395.1, 242/397, 397.1, 397.2, 397.3, 397.4, 403, 403.1; 137/355.26, 355.27; D8/358, 359; D34/24, 26

(56) References Cited

U.S. PATENT DOCUMENTS

| | | | | | |
|---|---|---|---|---|---|
| 1,115,325 | A | | 10/1914 | McCall | |
| 1,875,467 | A | * | 9/1932 | Knoerzer et al. | 242/397.3 |
| 2,606,067 | A | * | 8/1952 | Roark | 242/397.3 |
| 3,781,738 | A | * | 12/1973 | Rozelle | 242/397.4 |
| 4,777,976 | A | * | 10/1988 | Johnston et al. | 137/355.27 |
| 4,974,627 | A | | 12/1990 | Nelson | |
| D328,173 | S | * | 7/1992 | Nelson | D34/26 |
| 5,388,609 | A | | 2/1995 | Ghio et al. | |
| 5,425,391 | A | * | 6/1995 | Tisbo et al. | 137/355.27 |
| D363,207 | S | * | 10/1995 | Tisbo et al. | D8/359 |
| 5,758,685 | A | * | 6/1998 | Tisbo et al. | 137/355.27 |
| 5,901,730 | A | * | 5/1999 | Tisbo et al. | 137/355.27 |
| 5,988,552 | A | * | 11/1999 | Tisbo et al. | 242/403.1 |
| 6,050,290 | A | * | 4/2000 | Yacobi et al. | 242/397.3 |
| RE37,442 | E | * | 11/2001 | Spear et al. | 137/355.27 |
| 6,742,740 | B2 | * | 6/2004 | Tisbo et al. | 242/395 |

* cited by examiner

*Primary Examiner*—William A. Rivera
(74) *Attorney, Agent, or Firm*—McHale & Slavin PA

(57) ABSTRACT

The present invention relates to portable hose reel carts for handling and storage of flexible hoses, such as garden or air hoses. The cart is primarily constructed of plastic components having a centrally rotatable spool for winding of the flexible hose, a frame for supporting the spool, wheels at one end of the base of the frame, and a handle assembly for tilting the frame onto the wheels to facilitate moving the cart. The handle assembly which may or may not be foldable includes a crank mounted near the top of the handle assembly. The crank remotely drives the spool, for winding the hose, through a series of gears located within the handle. The device may further include a reciprocating guide assembly that operates during rotation of the spool to rewind the hose into a compact configuration.

35 Claims, 9 Drawing Sheets

HOSE REEL CART WITH ELEVATED CRANK HANDLE

FIELD OF THE INVENTION

This invention pertains to carts for use in storage of flexible hoses and more particularly, to a hose reel cart having an elevated crank handle to allow an operator to manually wind a hose reel from an upright position.

BACKGROUND INFORMATION

Portable hose reel carts for handling and storage of flexible water hoses, such as garden and air hoses, have gained wide public acceptance. While the construction of hose reel carts is quite varied, such carts are primarily constructed of molded plastic components having a centrally disposed rotatable spool for reeling of the flexible hose, a frame for supporting of the spool, wheels at one end of the base of the frame, and a frame handle for tilting the frame onto the wheels to facilitate moving the cart. The frame handle may, or may not be foldable for purposes of shipping and/or storage. For more information concerning the structure and operation of hose reel carts, reference may be made to U.S. Pat. No. Re. 32,510, and U.S. Pat. No. 5,998,552 the teachings of which are hereby incorporated by reference.

Common to hose reel carts is the use of a crank handle secured to a hub for use in rotation of a spool. The spools are typically arranged with the crank handle located at the center of the hub to wind the flexible hose. Attempts have been made to move the location of the crank handle, however, such attempts typically employ the use of a sprocket and chain assembly leaving little in the way of efficiency, ratio gearing, or the ability to compactly store such a device. The advantage of an elevated crank handle is to allow rotation of the spool by an operator who need not bend over to perform the operation. Standing upright lessens the strain on an individual's back but typically crank movement does not address the change in location for gearing leverage, or address storage of such a device.

For instance, U.S. Pat. No. 1,115,325 discloses a garden hose reel storage device wherein the spool is rotated from a crank mounted a distance above the spool. The remotely mounted crank is coupled by used of a chain sprocket for driving the spool mounted sprocket. A smaller sprocket by the hand crank provides a gear reduction from the larger sprocket adjacent to the spool. The direct coupling requires a large diameter spool sprocket that is difficult to shield and prohibits folding of the hand crank support arm.

U.S. Pat. No. 5,388,609 discloses a hose reel cart having a remotely mounted crank handle coupled to a spool by a chain and sprocket assembly. This disclosure utilizes an oversize crank handle thereby reducing the size of sprockets needed to transfer rotation from the hand crank to the hose reel spool.

U.S. Pat. No. 4,974,627 discloses a hose reel cart employing yet another sprocket and chain drive assembly. In this disclosure a crank sprocket is mounted along a side wall of the cart, at a slightly elevated position. The hand crank remains well below the cart handle. Thus, the device fails to take advantage of the highest point on the cart and continues to force the operator to crank the spool from a lower position. Further, the chain assembly must be mounted in the side wall as there is no teaching to place the chain assembly into a foldable cart handle.

Thus, what is lacking in the art is a hose reel cart having an elevated crank handle formed into a foldable cart handle support, the crank handle remaining in rotatable contact with hose reel spool at all times.

BRIEF DESCRIPTION OF THE INVENTION

Among the several aspects and features of the present invention may be noted the provision of an improved portable hose reel cart having a elevated hand crank for use in rotation of the reel spool wherein the hand crank is positioned within a foldable handle. In an additional embodiment, the elevated hand crank is also used for movement of a hose guide for positioning of the flexibe hose around the hose reel spool.

The hose reel cart of the present invention is of a shape and design so that the hose reel cart may be preassembled at the factory thereby eliminating the need for assembly and associated product packaging. Preassembly of the hose reel cart permits the use of a modular frame construction for support of a hose to be wound into a coil of multiple layers with adjacent turns of each layer touching each other by use of a directional spool rotatably coupled to a frame. The hose is wound around the spool by use of a remotely located crank providing an indirect rotational link between the crank and the winding of the spool. In the preferred embodiment, the crank is positioned in a foldable handle assembly that allows for ease of transporting fully assembled hose reel carts and subsequent storage. A hand-grip on the crank can also be placed in a storage position by pivoting the hand-grip about one end of the crank arm. The hand-grip having a releasable lock for securing the hand-grip in a parallel position with the crank arm for storage and securing the crank hand-grip in a perpendicular position to the crank arm for operation.

Thus, an objective of the instant invention is to provide a portable hose reel cart having an elevated crank handle formed integral with the hose reel cart handle wherein all components are preassembled so as to eliminate the need for assembly by the consumer, yet allow repeatable storage.

Another objective of the instant invention is to disclose the use of a locking tab that allows the crank handle to be locked in either a storage position or an operating position.

Yet another objective of the invention is to provide a portable hose reel cart having an elevated crank handle that can position a hose guide in addition to rotation of the hose reel hub.

Other objectives and advantages of this invention will become apparent from the following description taken in conjunction with the accompanying drawings wherein are set forth, by way of illustration and example, certain embodiments of this invention. The drawings constitute a part of the specification and include exemplary embodiments of the present invention and illustrate various objectives and features thereof.

DETAILED DESCRIPTION OF THE PREFERRED EMBODIMENTS

Figure 1:
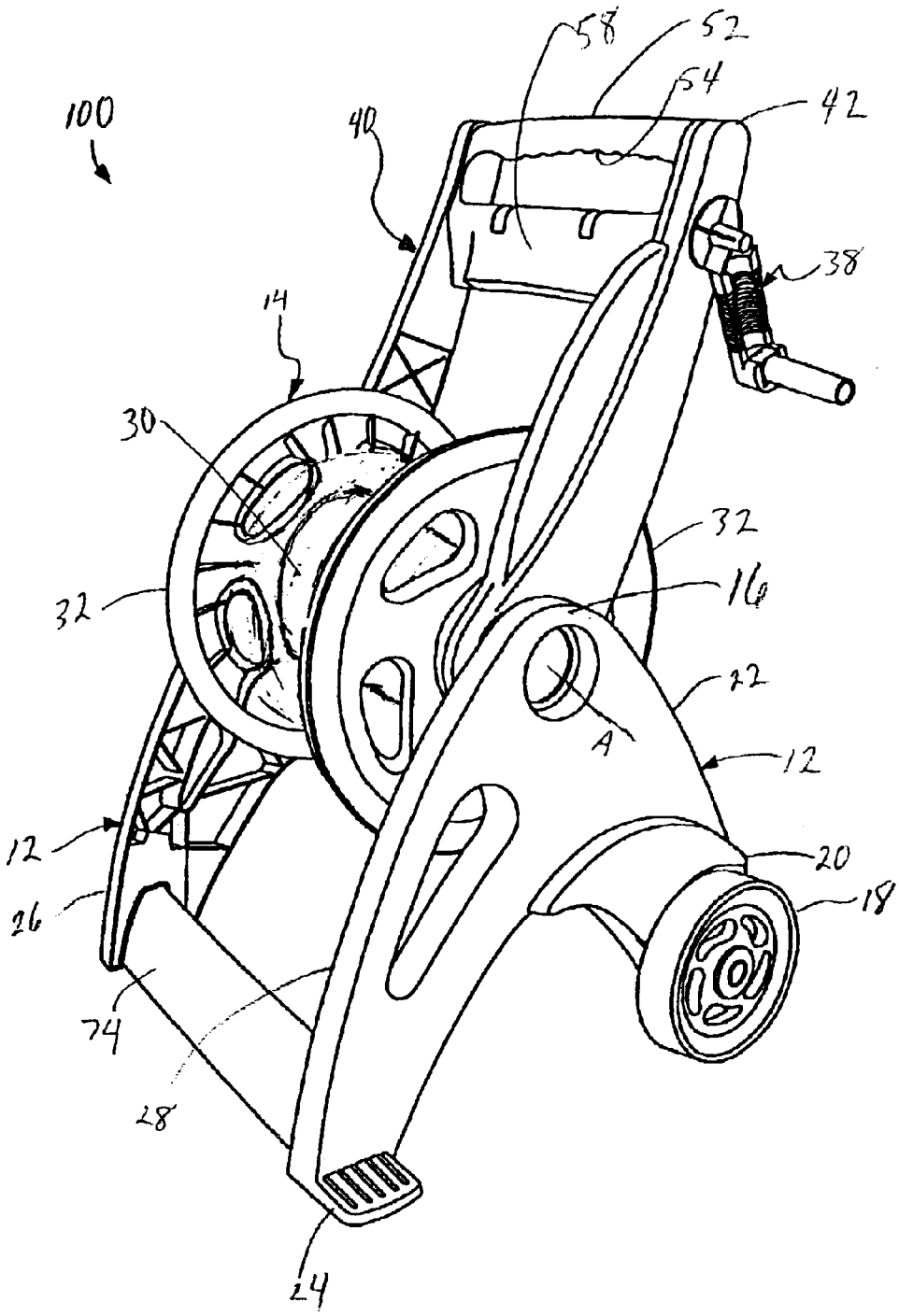
FIG. 1 is a perspective view of a portable hose reel cart having a folding handle.

While the present invention is susceptible of embodiment in various forms, there is shown in the drawings and will hereinafter be described a presently preferred embodiment with the understanding that the present disclosure is to be considered an exemplification of the invention and is not intended to limit the invention to the specific embodiments illustrated.

Figure 2:
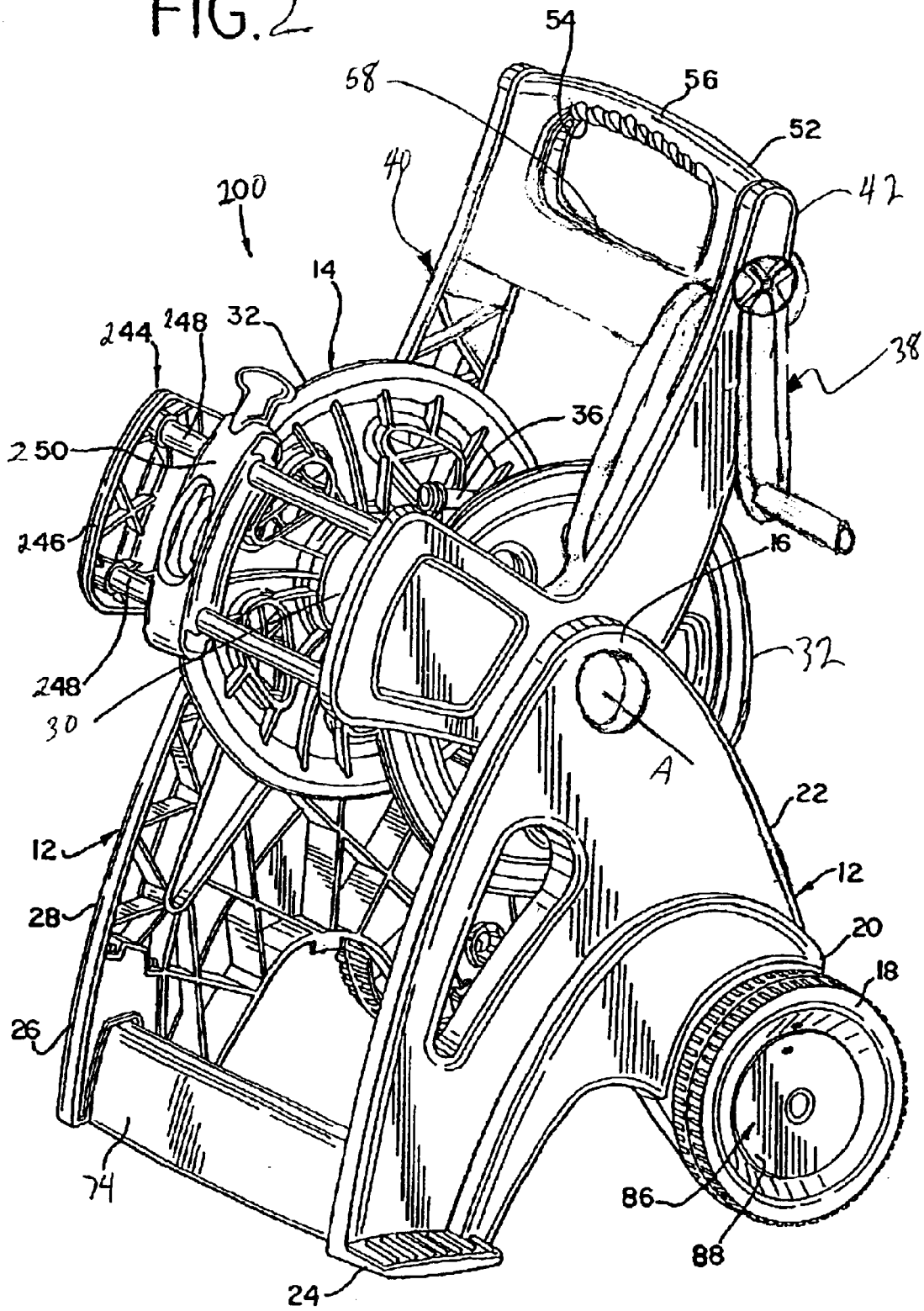
FIG. 2 is a perspective view of a portable hose reel cart having a folding handle with a manual hose guide assembly.
Figure 3:
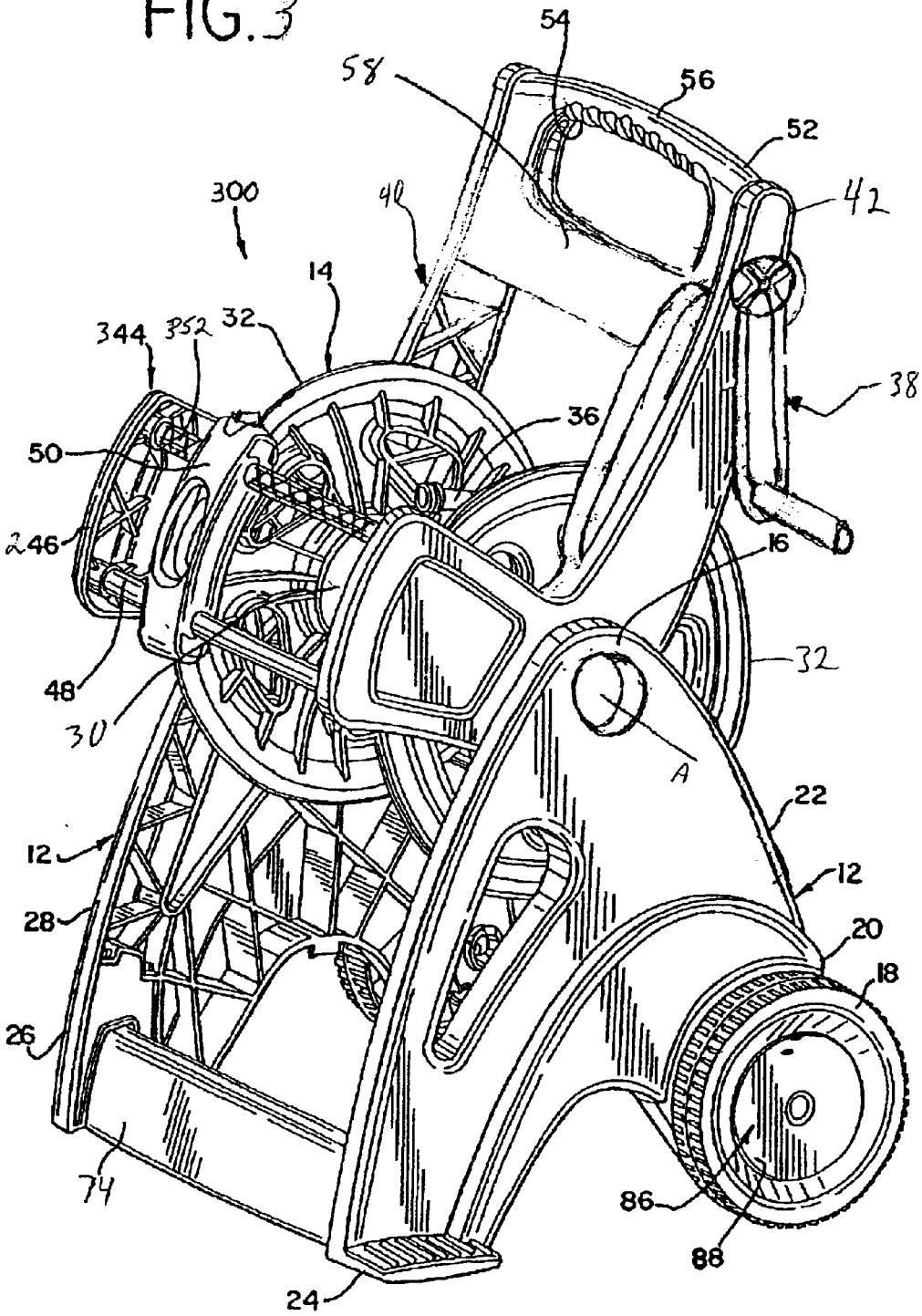
FIG. 3 is a perspective view of a portable hose reel cart having a folding handle with an automatic hose guide assembly.

Referring now to the figures, and generally to FIGS. 1–3, there is shown hose reel carts 100, 200, and 300 embodying the principles of the present invention. The hose reel carts provide hose storage around a winding apparatus employing a winding crank mounted near the top of the handle assembly to minimize operator stooping when winding a hose about the spool 14. The hose reel carts also provide for shipping and storing in a compact manner by folding of the handle assembly when not in use.

Optionally the hose reel carts 100, 200, and 300 provide a "base-station" when coupled to a water or air outlet; e.g., a water spigot or source of compressed air, so that an operator can pay-out as much hose as needed while one end of the hose remains coupled in fluid communication with the water or air supply.

The hose reel carts 100, 200, and 300 include a pair of side frames 12 that have a generally "A" or triangular shape. The side frames 12 support a spool assembly 14 at about the top or apex 16 of the frame 12. The spool 14 is rotatable and provides for pick-up, storage and pay-out of the hose. The carts include wheels 18 at the bottom 20 of the one of the legs 22 of the A-shaped frame 12 and a foot or rest 24 at the bottom 26 of at least one of the other of the frame legs 28.

The spool 14 includes a central hub 30 and a pair of radially extending flanges 32 that are configured to accommodate a length of flexible hose wrapped around the hub 30 between the flanges 32. In a typical arrangement, the cart 10 may store about 200 to 300 feet of a ⅝ inch common hose. Those skilled in the art will recognize that the cart 10 may include a water/air inlet port or in-tube (not shown) and an outlet port or out-tube 36. Typically the in-tube is mounted to the frame 12 at about the axis of rotation A of the spool 14. The in-tube is connected to the out-tube 36 by a sliding seal arrangement (not shown) so that the in-tube remains fixed to the frame 12, while the out-tube 36 rotates with the spool 14, and the in-tube and out-tube 36 remain in fluid communication with one another. This arrangement permits rotation of the spool 14 without twisting or torquing internal components, while maintaining sealed fluid communication between the water/air supply and the hose. The preferred in-tube and coupling arrangement can be viewed in U.S. Pat. No. 5,998,552, the contents of which are incorporated herein by reference.

Figure 4:
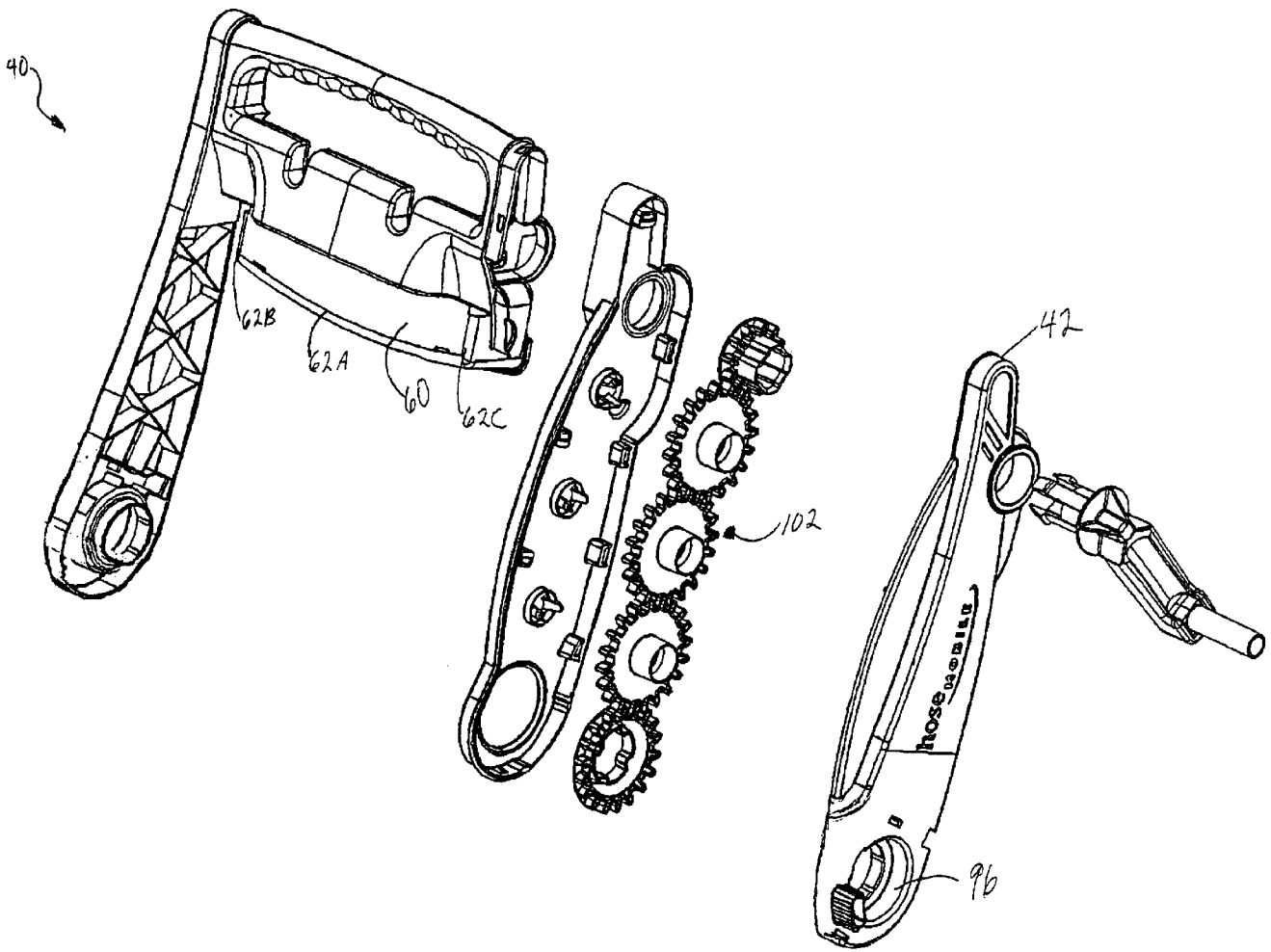
FIG. 4 is a front exploded perspective view of the handle assembly with the spool rotational drive means.
Figure 5:
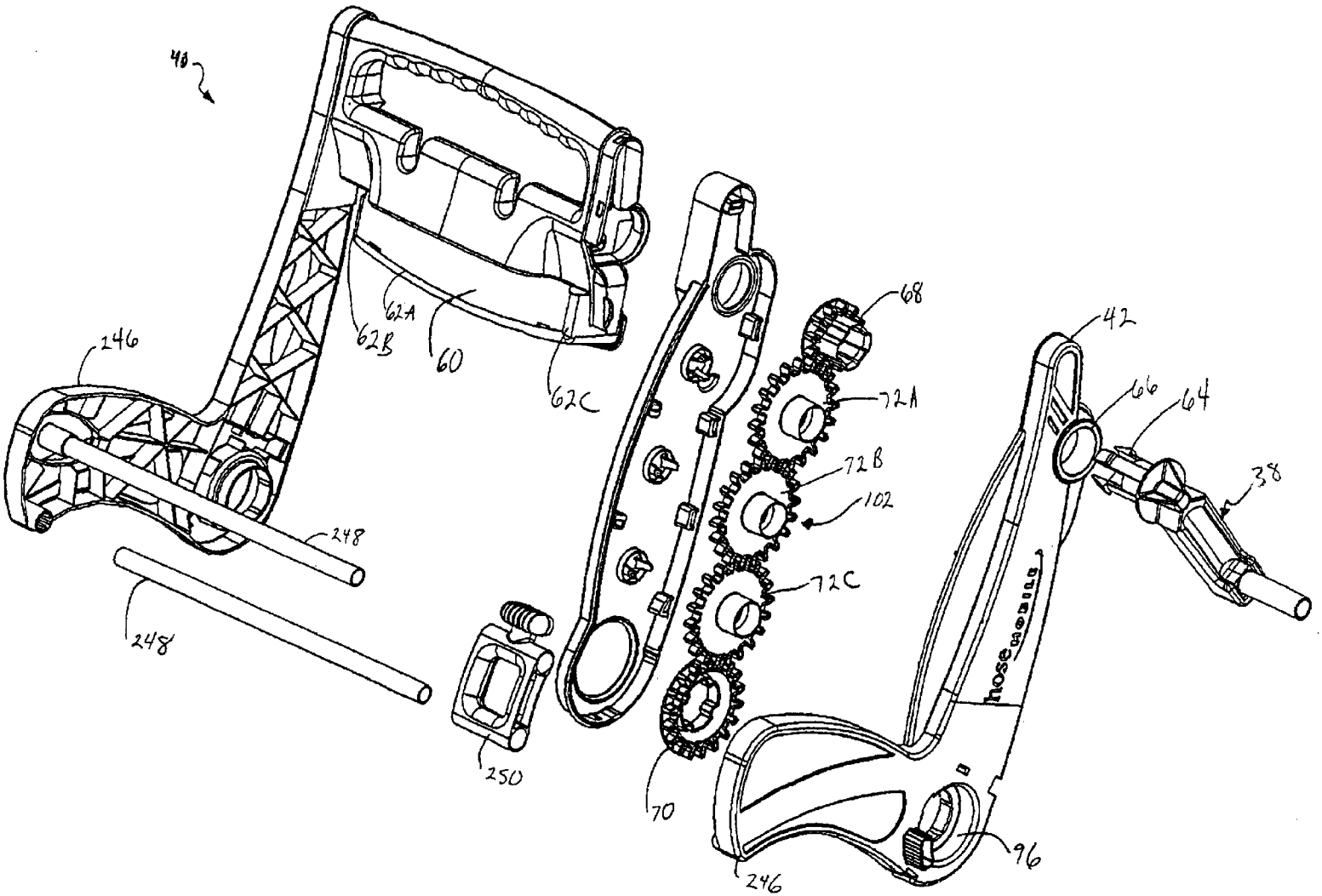
FIG. 5 is a front exploded perspective view of the handle assembly with the guide support arms, the manual hose guide, and the spool rotational drive means.
Figure 6:
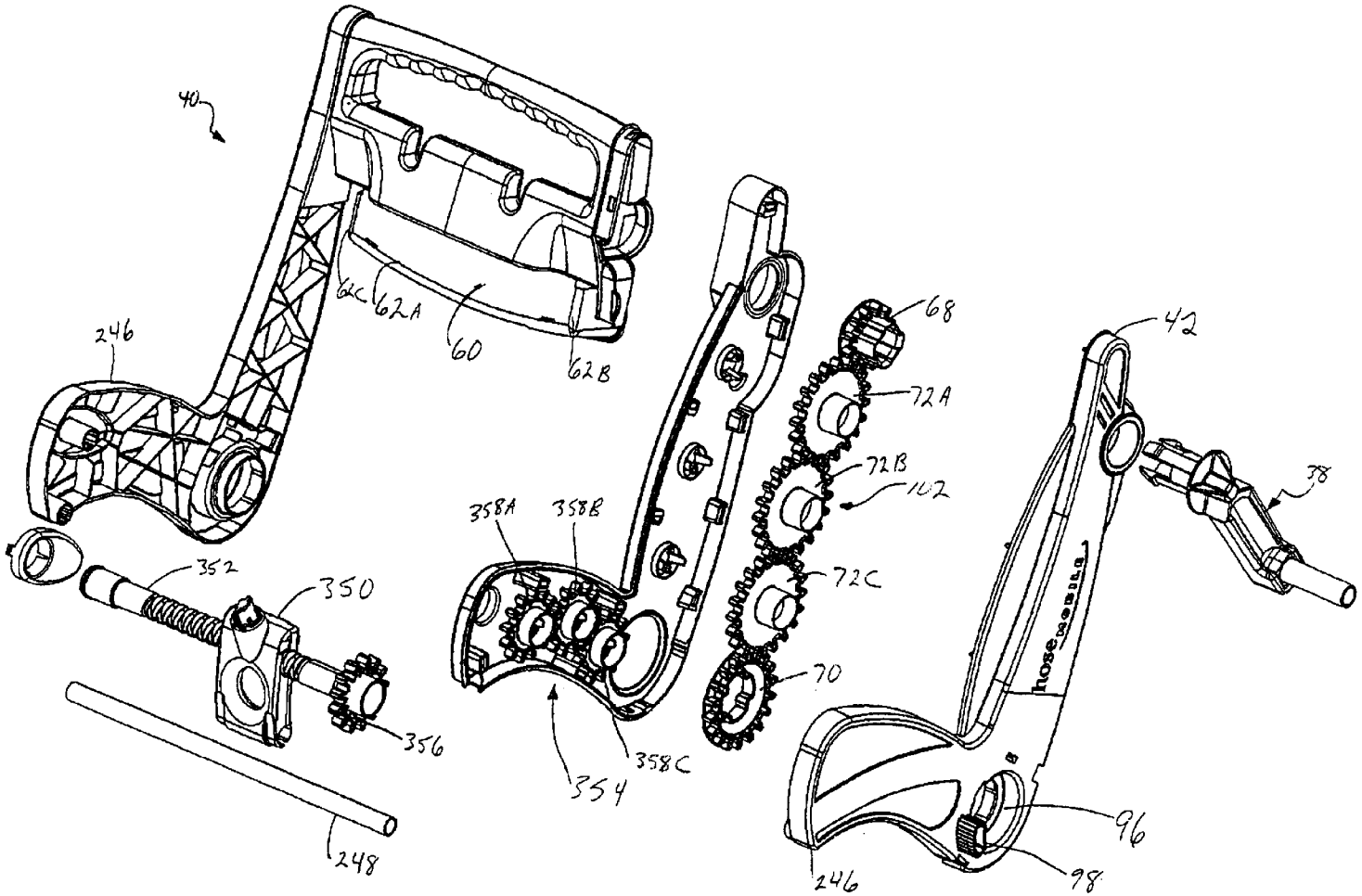
FIG. 6 is a front exploded perspective view of the handle assembly with the guide support arms, the automatic hose guide, and the spool rotational drive means.
Figure 9:
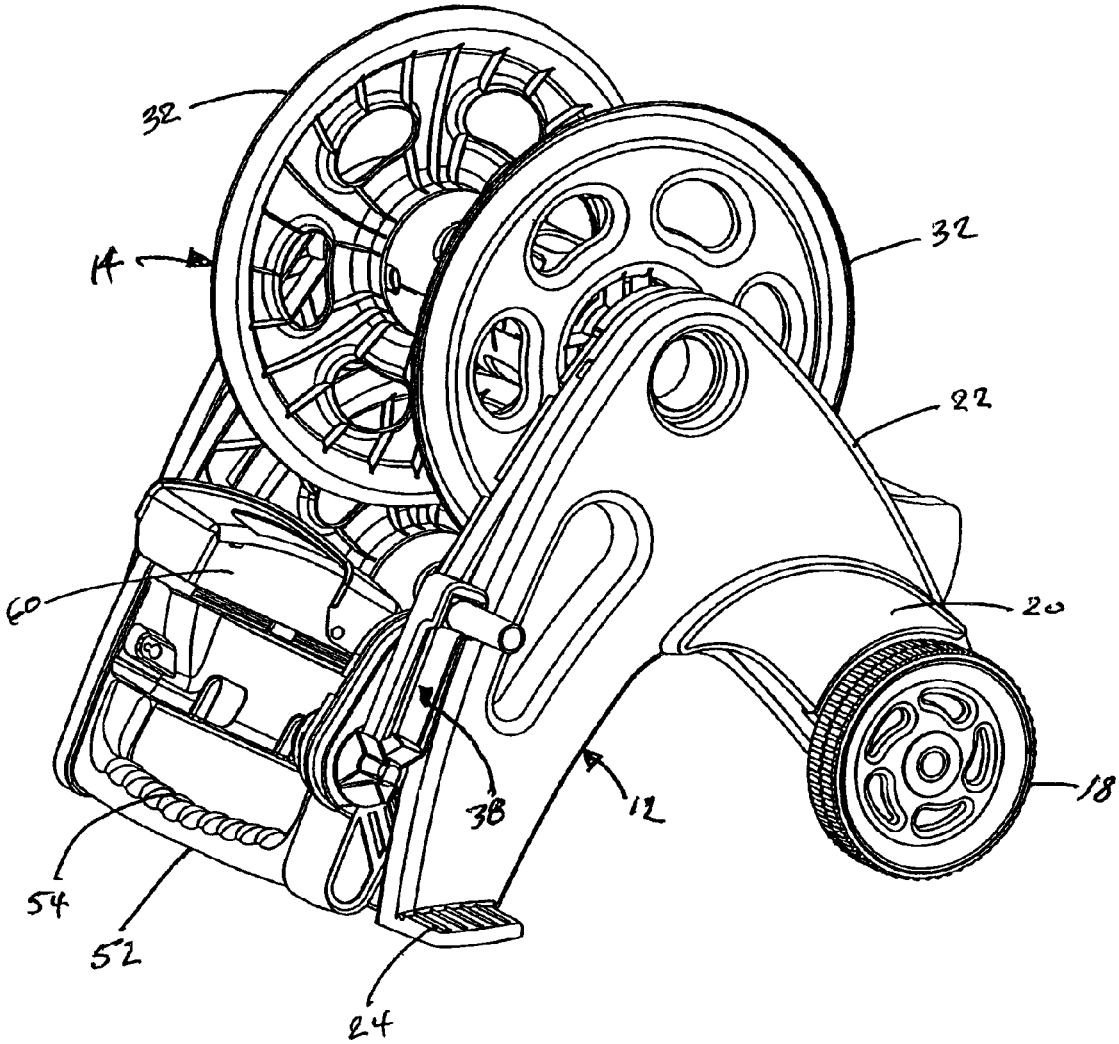
FIG. 9 is a perspective of the hose reel in the storage position.

In the preferred embodiment a folding handle assembly 40 extends from the carts 100, 200, and 300 and includes a pair of arms 42 that are pivotally mounted to the carts 100, 200, and 300 intermediate the spool flanges 32 and their respective frame 12 connections. In this manner, the cart handle assembly 40 pivots essentially co-axially with the spool 14. That is, the cart handle 40 pivots about the axis of rotation A of the spool 14. The handle 40 is pivotal between a storage position, shown in FIG. 9, and an in-use position as shown in FIGS. 1–3. A crank assembly 38 is rotatably supported and journaled in the upper portion of one side of the handle assembly 40 and connected to the spool 14 via a gear-train 102 to facilitate spool 14 rotation from an elevated position. A typical gear-train 102 arrangement for rotating the spool is illustrated in FIGS. 4–6. Optionally, as shown in FIGS. 2 and 3, the cart can include a manual guide assembly 244 or an automatic guide assembly 344 to guide the hose as it is picked-up onto the spool 14 to distribute the hose evenly across the spool 14.

In one embodiment, a manual guide assembly 244 includes a pair of guide support arms 246 integral with the handle assembly 40 that extend generally transverse to the handle assembly arms 42. A pair of guide rails 248 extend between the support arms 246. A guide 250 is manually slidable along the rails 248 to facilitate even distribution of the hose onto the spool 14.

In a preferred embodiment, the guide assembly is automatically reciprocated with the spool. The automatic guide assembly 344 includes a double-helix lead screw 352 suitably supported and journaled in the guide support arms 246 for rotational movement and a single guide rod 248 extending between the support arms 246. When the spool 14 is rotated a guide gear train 354 illustrated in FIG. 6, transfers rotary motion from the spool 14 to the double-helix lead screw 352. A guide 350 cooperates with the double-helix lead screw 352 and slides along the guide rod 248 to cause the guide 350 to reciprocate back and forth across the spool 14 facilitating even distribution of the flexible elongate member onto the spool.

Referring now to FIGS. 1–6, the handle assembly 40 includes a pair of spaced apart mounting arms 42 and a gripping portion 52 that extends between the arms 42. The gripping portion 52 defines an opening 54 and an upper portion or grip 56 for grasping the handle assembly 40. In the illustrated embodiments, the handle assembly 40 includes a lower portion 58 (FIGS. 4–6) that is preferably configured as a storage bin 60. The storage bin is formed in one piece as part of the gripping portion 52 with living hinges 62A, 62B, and 62C. The storage bin sides are fastened to the lower portion 58 of the gripping portion 52 for stability and strength. The storage bin 60 can be used to store various hose attachments, such as, spray heads, nozzles and the like. Consumers will recognize the advantage to having the handy storage bin 60 mounted to the handle assembly 40, so that hose attachments can be readily stored with the hose and easily accessed, rather than stored in another location and possibly misplaced or lost.

Referring now to FIGS. 4–6, the handle assembly 40 includes an open circular collar portion 96 that defines the pivot for the assembly 40. A short connecting stub (not shown) extends from each side frame 12 and inserts into the collar 96 to provide a pivot about which the handle 40 assembly rotates. A pivot stop 98 extends outwardly from the handle assembly 40 into an arcuate channel formed in the side frame 12 (not shown). The channel defines the travel path and the length of travel or rotation of the handle assembly 40 as it pivots between the in-use and storage positions.

Referring now to FIGS. 4–6, in order to provide manual rotation of the hose reel 14 and reciprocation of the automatic hose guide 344, a rotational drive means is positioned longitudinally within one of the mounting arms 42. The rotational drive means includes the crank assembly 38, the reel gear-train 102 and optionally the hose guide gear-train 354. The crank assembly 38 includes an input shaft 64 extending inwardly through an opening 66 in the outer wall of an upper portion of the mounting arm 42 and rotatable with respect thereto. The input shaft 64 is secured to the first input gear 68 of the gear train 102 at a position within the mounting arm 42. The spool gear 70 is suitably secured to the spool 14 so as to be rotatable therewith. Idler gears 72A, 72B, and 72C are positioned within the mounting arm 42 to be freely rotating with respect to the mounting arm and directly meshed with the input gear 68, one another, and the spool gear 70 to provide direct gear powering therebetween. Thus, rotational movement of the input gear 68 with handle assembly 38 will cause similar rotational movement of the spool gear 70 and spool 14. Preferably the spool gear 70 will be larger than the input gear 68 thereby achieving a torque increasing gear reduction desired by the present invention.

The automatic hose guide gear-train 354 utilizes rotation of the spool 14 to cause rotation of the double-helix lead screw 352. The lead screw gear 356 is suitably secured to the lead screw 352 to be rotatable therewith. Idler gears 358A, 358B, and 358C are positioned within the transverse guide support arm 256 to be freely rotating with respect to the guide support arm 256 and directly meshed with the spool gear 70, one another, and the lead screw gear 356 to provide direct gear powering therebetween. Thus, rotational movement of the spool gear 70 will cause similar rotational movement of the lead screw gear 356 and reciprocation of the hose guide 350. Preferably the spool gear 70 will be larger than the lead screw gear 356 thereby achieving the desired amount of hose guide 350 travel per spool 14 revolution for a compact hose storage configuration.

In order to provide additional rigidity to the carts 100, 200, and 300 a front lateral support beam 74 may extend between and connect the bottom front frame legs 28 at about the foot 24. The front beam 74 can be integral with the side frames 12, or can be connected thereto by methods that will be recognized by those skilled in the art. The front beam 74 increases the structural integrity of the carts 100, 200, and 300 overall by preventing the side frames 12 from bowing or bending, inwardly or outwardly, relative to one another and thus, adversely affecting the operation of the handle assembly 40 or the rotation of the spool 14. The carts may also include a rear lateral support beam 76 (FIG. 7) that extends between and connects the side frames 12 at about the wheels 18. The rear beam 76 is positioned rearward and off-center of the axis of rotation of the wheels 18. In this manner, the rear support beam 76 provides a foot rest, essentially independent of any wheel 18 rotation device or mechanism, for securing the cart while pulling rearward on the handle 40 to tilt the cart for movement.

Figure 7:
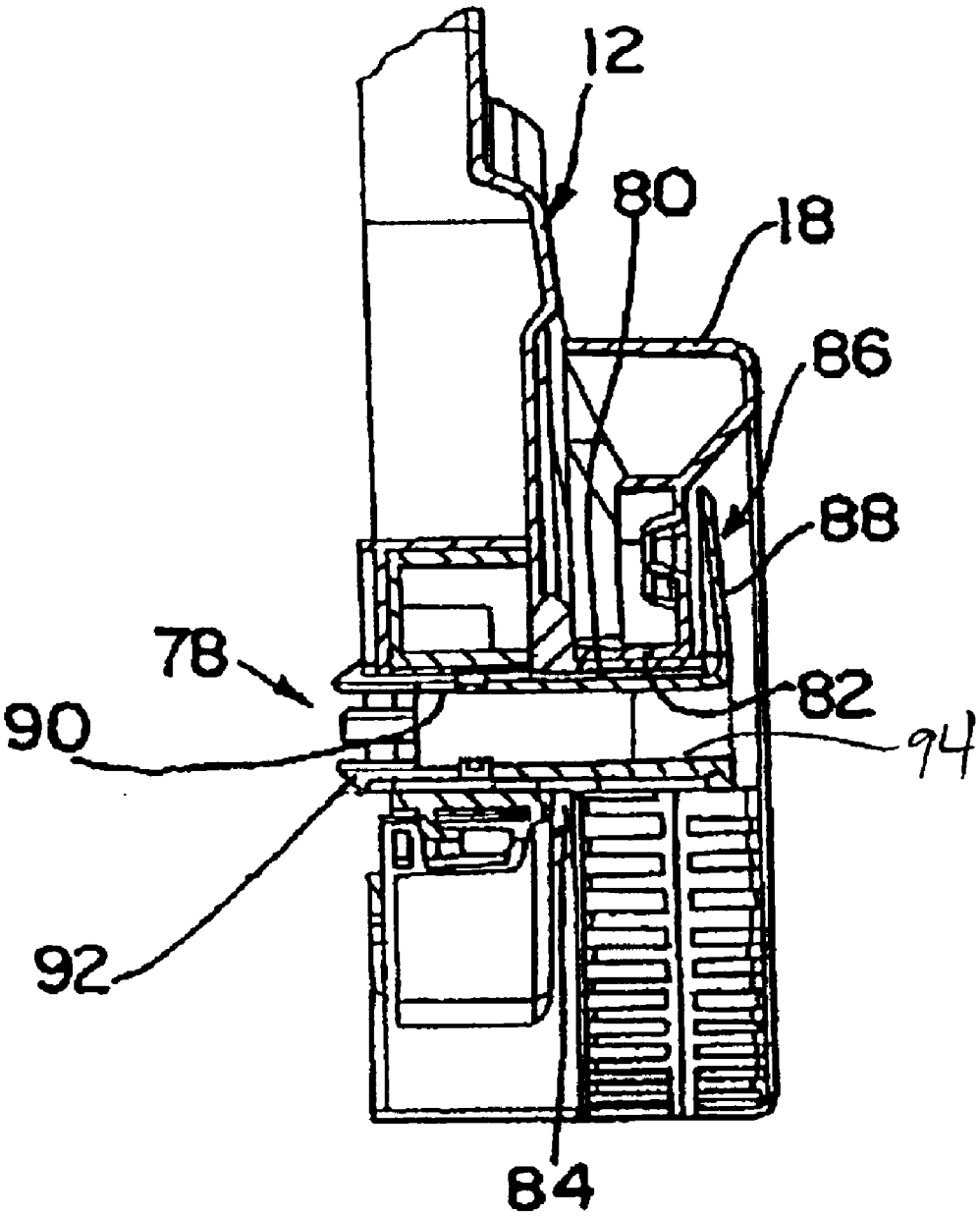
FIG. 7 is a partial cross-sectional view of a wheel and wheel support assembly.

Referring now to FIG. 7, there is shown the wheel support assembly 78. Each wheel support assembly 78 secures a wheel 18 to the cart 10. The side frames 12 each include an outwardly extending tubular-like projection or hub 80, that is configured for receipt in a central opening 82 formed in the wheel 18. In this manner, support for each wheel 18 is independent of support for the other wheel 18, and is provided by the side frames 12, rather than an axle that extends across or traverses the rear portion of the cart. The hub 80 can include gussets 84 extending between the hub 80 and the outer wall of the side frame 12 to provide additional structural rigidity to the wheel support assembly 78.

The wheel support assembly 78 includes a locking plate 86 having a wheel plate 88 and a stub 90 extending from the plate 88. The stub 90 is configured for insertion through the central opening 82 of the wheel 18. The plate 88 abuts the wheel 18 as the stub 90 extends through the wheel opening 82 and hub 80. Detent or snap-type fasteners, such as those illustrated at 92, can be used to secure the stub 90 to the inner wall 72. Those skilled in the art will appreciate that the snap-type fasteners 92 can be used throughout the carts 100, 200, and 300 to mount or secure components to one another, and to facilitate ready assembly of the carts if it is provided in an unassembled manner.

Figure 8:
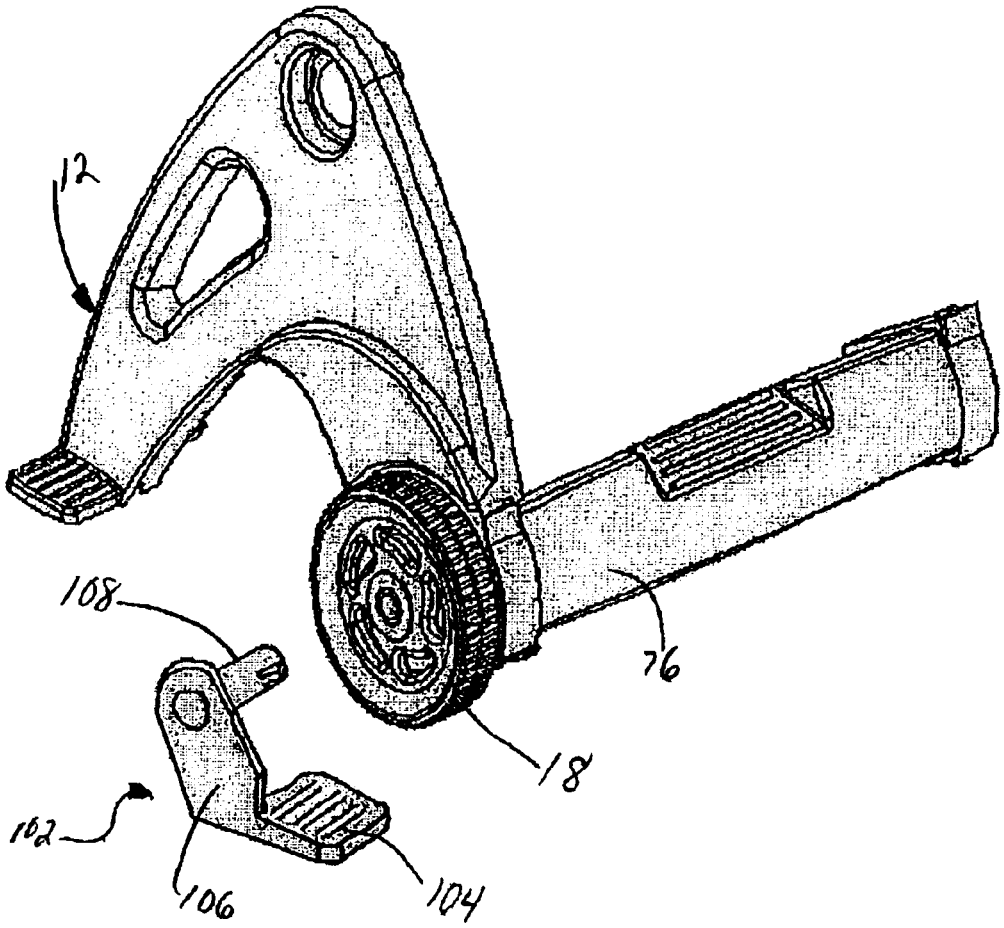
FIG. 8 is a perspective and partially exploded view illustrating the wheel chock assembly and the rear lateral support beam.

Referring now to FIG. 8, there is shown a rotatable wheel chock 102. The wheel chock 102 includes a foot plate 104, a chock plate 106 and a chock stub 108. The chock stub 108 is configured for insertion through the central opening 94 of the wheel stub 90. The chock plate 106 abuts the wheel 18 and wheel plate 88 as the chock stub 108 extends through the wheel stub opening 94 and hub 80. Detent or snap-type fasteners, such as those illustrated at 92, can be used to secure the chock stub 108 to the central opening of the wheel stud 94. The foot plate 104 may be formed integral to the chock plate 106 and be configured to wedge between the wheel 18 and a surface to resist unwanted movement of the portable reel during manual winding of the hose.

As will be appreciated by those skilled in the art from a study of the figures and the above description, the carts 100, 200, and 300 are formed primarily from molded components. In a present form, the carts 100, 200, and 300 are formed primarily from high density polyethylene (HDPE) using an injection molding process. Those skilled in the art will recognize that there are various other materials that can be used to form the carts 100, 200, and 300 components and various other processes by which the components can be made, which other materials and process are within the scope of the present invention.

All patents and publications mentioned in this specification are indicative of the levels of those skilled in the art to which the invention pertains. All patents and publications are herein incorporated by reference to the same extent as if each individual publication was specifically and individually indicated to be incorporated by reference.

It is to be understood that while a certain form of the invention is illustrated, it is not to be limited to the specific form or arrangement herein described and shown. It will be apparent to those skilled in the art that various changes may be made without departing from the scope of the invention and the invention is not to be considered limited to what is shown and described in the specification.

One skilled in the art will readily appreciate that the present invention is well adapted to carry out the objectives and obtain the ends and advantages mentioned, as well as those inherent therein. The embodiments, methods, procedures and techniques described herein are presently representative of the preferred embodiments, are intended to be exemplary and are not intended as limitations on the scope. Changes therein and other uses will occur to those skilled in the art which are encompassed within the spirit of the invention and are defined by the scope of the appended claims. Although the invention has been described in connection with specific preferred embodiments, it should be understood that the invention as claimed should not be unduly limited to such specific embodiments. Indeed, various modifications of the described modes for carrying out the invention which are obvious to those skilled in the art are intended to be within the scope of the following claims.

What is claimed is:

1. A hose reel cart having a remote spool crank mounted in an uppermost portion of a handle assembly to allow rotation of a hose storage spool from an elevated position, said hose reel cart comprising:

first and second frame side members;

a rotatable spool assembly located between said frame members, said spool assembly operably connected thereto for rotation of said spool about an axis of rotation;

said handle assembly including a pair of spaced apart arms mounted between said side members;

a rotational drive means positioned longitudinally within at least one of said mounting arms;

said rotational drive means including a gear-train coupled between said crank and said spool; said gear-train having a first input gear secured to said first input shaft at a position within said mounting arm;

at least one idler gear rotatably secured within said mounting arm and being positioned in engagement with respect to said input gear to be rotatable responsive to rotation thereof; and a spool gear coupled to said spool to be rotatable therewith and being positioned in engagement with respect to said at least one idler gear to be rotatable responsive to rotation thereof, said reel gear being larger than said first input gear to cause said spool gear to rotate at a rotational speed less than the rotational speed of said first input gear;

wherein operation of said rotational drive means provides rotational movement of said spool.

2. The hose reel cart in accordance with claim 1, wherein said crank assembly includes a handle connected to said crank, said handle having a releasable lock securing said handle between a parallel position with said crank and a perpendicular position to said crank, said handle movable between said positions when said lock is released.

3. The hose reel cart in accordance with claim 1, wherein said gear-train is further defined as a first input gear secured to said first input shaft at a position within said mounting arm;

a first idler gear rotatably secured within said mounting arm and being positioned in engagement with respect to said input gear to be rotatable responsive to rotation thereof;

a second idler gear rotatably secured within said mounting arm and being positioned in engagement with respect to said first idler gear to be rotatable responsive to rotation thereof;

a third idler gear rotatably secured within said mounting arm and being positioned in engagement with respect to said second idler gear to be rotatable responsive to rotation thereof;

a spool gear secured to said spool to be rotatable therewith and being positioned in engagement with respect to said third idler gear to be rotatable responsive to rotation thereof, said spool gear being larger than said first input gear to cause said spool gear to rotate at a rotational speed less than the rotational speed of said first input gear.

4. The hose reel cart in accordance with claim 1, wherein at least one of said mounting arms includes an inner panel releasably secured thereto, said inner panel structurally supporting said rotational drive means within said mounting arm.

5. The hose reel cart in accordance with claim 1, wherein each said side frame includes an outwardly extending hub adapted to receive a wheel.

6. The hose reel cart in accordance with claim 5, including a wheel locking member having a plate and a stub extending therefrom, said stub adapted for receipt in said hub so that said plate abuts said wheel to secure said wheel to said side frame.

7. The hose reel cart in accordance with claim 1, including a manual guide assembly for guiding a hose wound onto said spool; wherein said hose is manually distributed uniformly and smoothly across said spool for a compact storage configuration.

8. The hose reel cart in accordance with claim 7, wherein said manual guide includes: a pair of guide support arms formed integral to said mounting arms and extending generally transverse to said mounting arms; a pair of guide rails secured to and extending between said guide support arms, said pair of guide rails substantially parallel and spaced apart in relation to one another and said axis of rotation of said spool; and a guide manually slidable along said rails; wherein manually guided distribution of said hose about said spool is facilitated.

9. The hose reel cart in accordance with claim 1, including an automatic guide assembly for guiding a hose as it is wound onto said spool.

10. The hose reel cart in accordance with claim 9, wherein said automatic guide assembly includes a pair of guide support arms formed integral to said mounting arms and extending generally transverse to said mounting arms; a double-helix lead screw substantially parallel to and spaced apart from said spool axis of rotation and journaled in said guide support arms; a guide constructed and arranged to cooperate with said double-helix lead screw and said guide rod; and a guide gear train constructed and arranged to transfer rotary motion from said spool to said double helix lead screw; wherein said guide reciprocates back and forth across said lead screw and said guide rod when said spool is rotated to uniformly and smoothly guide a flexible hose on said reel.

11. The hose reel cart in accordance with claim 10, wherein said guide gear-train includes a spool gear secured to said hub of said spool to be rotatable therewith; at least one idler gear rotatably secured within said guide support arm and being positioned in engagement with respect to said spool gear to be rotatable responsive to rotation thereof; a lead screw gear secured to said lead screw to be rotatable therewith and being positioned with respect to said at least one idler gear to be rotatable responsive to rotation thereof; wherein said lead screw rotates responsive to said spool to cause said guide to reciprocate back and forth across said lead screw.

12. The hose reel cart in accordance with claim 1, including at least one rear lateral support extending between and connecting said side frames at about said base portions thereof, said at least one rear lateral support having at least one locking projection received by said side frames.

13. The hose reel cart in accordance with claim 1, including at least one front lateral support extending between and connecting said side frames at about said base portions thereof, said at least one front lateral support having at least one locking projection received by said side frames.

14. A hose reel cart having a remote spool crank mounted in an uppermost portion of a handle assembly to allow rotation of a hose storage spool from an elevated position, said hose reel cart comprising:

first and second frame side members;

a rotatable spool assembly located between said frame members, said spool assembly operably connected thereto for rotation of said spool about an axis of rotation;

said handle assembly including a pair of spaced apart arms mounted between said side members;

a rotational drive means positioned longitudinally within at least one of said mounting arms; said rotational drive means including a gear-train coupled between said crank and said spool;

wherein operation of said rotational drive means provides rotational movement of said spool; wherein each said side frame includes an outwardly extending hub adapted to receive a wheel, including a wheel locking member having a plate and a stub extending therefrom, said stub adapted for receipt in said hub so that said plate abuts said wheel to secure said wheel to said side frame, further including at least one rotatable wheel chock for stabilizing said portable reel cart during hose winding; wherein said outwardly extending hub of said each side frame provides a pivot about which said at least one wheel chock rotates, said at least one wheel chock rotatable to a storage position for movement of said hose cart and rotatable to a surface engagement position for stabilization during hose winding.

15. A portable hose reel cart having a remote spool crank mounted in an uppermost portion of a handle to allow rotation of a hose storage spool from an elevated position, said hose reel cart comprising:

a pair of spaced apart side frame members;

a rotatable spool positioned between said side frames and operably connected thereto for rotation of said spool about an axis of rotation;

a folding handle assembly having a pair of spaced apart mounting arms, said mounting arms having an upper portion and a lower portion, said mounting arms having a gripping portion extending between said upper portion of said mounting arms, each of said mounting arms associated with one of said side members respectively, said handle assembly being pivotable relative to said side frame members between a storage position and an in-use position, a rotational drive means positioned longitudinally within at least one of said mounting arms;

at least one wheel rotatable mounted to each said side member;

wherein manual operation of said rotational drive means provides selective rotational movement of said spool in relation to said frame members and hose winding to a compact configuration is accomplished, wherein said rotational drive means includes a gear-train, said gear-train coupled between said crank assembly and said spool; wherein said gear-train includes; a first input gear, said first input gear secured to said first input shaft at a position within said mounting arm; at least one idler gear, said idler gear rotatably secured within said mounting arm and being positioned in engagement with respect to said input gear to be rotatable responsive to rotation thereof; a spool gear, said spool secured to said spool to be rotatable therewith and being positioned in engagement with respect to said at least one idler gear to be rotatable responsive to rotation thereof.

16. The portable hose reel cart in accordance with claim 15, wherein said rotational drive means includes a crank assembly, said crank assembly being outwardly and rotatably secured to the upper portion one of said mounting arms, said crank assembly having a first input shaft extending inwardly through an opening defined in an outer wall of said mounting arm, said crank assembly operatively coupled to said rotational drive means for selectively driving thereof to cause rotation of said spool.

17. The portable reel cart having a raised crank position in accordance with claim 16, wherein said crank assembly includes a handle connected to said crank, said handle having a releasable lock, said releasable lock securing said handle in a parallel position with said crank and securing said handle in a perpendicular position to said crank, said handle movable between said positions when said lock is released.

18. The portable hose reel cart in accordance with claim 16, wherein said crank has a resilient locking tab carrying a pawl and said handle has locking detents cooperating with said pawl to lock said handle in said parallel position and said perpendicular position.

19. The portable hose reel cart in accordance with claim 16, wherein said locking tab is connected to said crank by a living hinge.

20. The portable hose reel cart in accordance with claim 15, wherein said rotational drive means includes a gear-train, said gear-train coupled between said crank assembly and said spool; wherein said spool rotates at a slower rotational speed than said first input shaft.

21. The portable reel cart in accordance with claim 15 wherein at least one of said mounting arms further includes an inner panel releasably secured to said at least one mounting arm; wherein said inner panel structurally supports and encloses said rotational drive means within said mounting arm.

22. The portable hose reel cart in accordance with claim 15, including a wheel locking member having a plate and a stub extending therefrom, said stub adapted for receipt in said hub so that said plate abuts said wheel to secure said wheel to said side frame.

23. The portable hose reel cart in accordance with claim 15, including at least one rotatable wheel chock for stabilizing said portable reel cart during said manual hose winding; wherein said outwardly extending hub of said each side frame provides a pivot about which said at least one wheel chock rotates, said at least one wheel chock rotatable to an out of the way position for movement of said hose cart and rotatable to a surface engagement position for stabilization during said manual hose winding.

24. The portable hose reel cart in accordance with claim 23, wherein said at least one rotatable wheel chock includes a chock stub portion having a snap type fastener for insertion into said wheel hub for securing said wheel chock to said side frame in a rotatable fashion; a chock plate having a first end and a second end, said first end secured to said chock stub, said second end secured to a foot plate; a foot plate configured and arranged to utilize operator foot pressure to engage a surface to resist unwanted movement of said portable hose cart during said manual winding of said hose.

25. The portable reel cart having a raised crank position in accordance with claim 15, including a manual guide assembly for guiding a hose as it is wound onto said spool; wherein said hose is manually distributed uniformly and smoothly across said spool for a compact storage configuration.

26. The portable reel cart having a raised crank position in accordance with claim 25, wherein said manual guide includes: a pair of guide support arms formed integral to said mounting arms and extending generally transverse to said mounting arms; a pair of guide rails secured to and extending between said guide support arms, said pair of guide rails substantially parallel and spaced apart in relation to one another and said axis of rotation of said spool; a guide manually slidable along said rails; wherein manually guided distribution of said hose about said spool is facilitated.

27. The portable hose reel cart in accordance with claim 15, including an automatic guide assembly for guiding a hose as it is wound onto said spool; wherein upon rotation of said spool said hose is automatically distributed uniformly and smoothly across said spool for a compact storage configuration.

28. The portable hose reel cart in accordance with claim 27, wherein said automatic guide assembly includes:

a pair of guide support arms formed integral to said mounting arms and extending generally transverse to said mounting arms;

a double-helix lead screw substantially parallel to and spaced apart from said spool axis of rotation and suitably supported and journaled in said guide support arms;

a guide rod secured to and extending between said guide support arms substantially parallel to and spaced apart from said spool axis of rotation and said double-helix lead screw;

a guide constructed and arranged to cooperate with said double-helix lead screw and said guide rod; and a guide gear-train, said gear-train constructed and arranged to transfer rotary motion from said spool to said double helix lead-screw; wherein said guide reciprocates back and forth across said lead screw and said guide rod when said spool is rotated to uniformly and smoothly wrap said flexible elongate member on said reel for a compact storage configuration.

29. The portable reel cart having a raised crank position in accordance with claim 15, including at least one rear lateral support extending between and connecting said side frames at about said base portions thereof, said at least one rear lateral support having at least one locking projection received by said side frames.

30. The portable reel cart having a raised crank position in accordance with claim 15, including at least one front lateral support extending between and connecting said side frames at about said base portions thereof, said at least one front lateral support having at least one locking projection received by said side frames.

31. The portable hose reel cart in accordance with claim 15, including a lock assembly positioned in the lower portion of each of said handle assembly mounting arms, each lock assembly including a latch received in said mounting arm, each latch including a projection moveable between and engaged position wherein each said projection engages its respective side frame and a disengaged position wherein each said projection is disengaged from its respective side frame, each said latch including a release button extending through an opening defined in an outer wall of each respective mounting arm, wherein said collar and said stub openings align with one another when said handle is in said in-use position.

32. A hose reel cart comprising a frame having a handle assembly and a support, said handle assembly and said support being rotatably connected;

said handle assembly including spaced apart first and second arms, said first and second arms each having a top end and a bottom end, a handle mounted between said arms at said top end, a remote spool crank mounted in said top end of one of said arms, a rotational drive positioned longitudinally within said one of said arms, said crank operatively connected to said rotational drive;

said support having spaced apart side frames each having an upper end and a lower end, each said upper end including a portion of a rotatable spool assembly extending between said side frames and providing an axis of rotation;

each of said first and second arms of said handle assembly pivotally connected to said spool assembly about said axis of rotation, said rotatable drive operatively connected to said spool assembly whereby turning said crank rotates the spool; and said handle assembly rotatable about said axis of rotation bringing said top end of said handle assembly toward said lower end of said support to reduce the overall dimensions of said hose reel cart.

33. A hose reel cart of claim 32 wherein said each of said side arms of said support are A shaped with said spool assembly rotatably connected at the apex said A shaped side arms.

34. A hose reel cart of claim 32 wherein each of said first and second arms is L shaped, each of said arms including two legs joined at angles, said handle connected at one end of said legs, said axis of rotation located at said angles and a guide assembly is attached between said two legs at the other end.

35. A hose reel cart of claim 34 wherein said each of said side arms of said support are A shaped with said spool assembly rotatably connected at the apex said A shaped side arms.

* * * * *